US011566433B2

(12) United States Patent
Flores

(10) Patent No.: US 11,566,433 B2
(45) Date of Patent: Jan. 31, 2023

(54) GROUT LEVELER TOOL

(71) Applicant: Raymundo Armenta Flores, Avon, FL (US)

(72) Inventor: Raymundo Armenta Flores, Avon, FL (US)

( * ) Notice: Subject to any disclaimer, the term of this patent is extended or adjusted under 35 U.S.C. 154(b) by 0 days.

(21) Appl. No.: 17/219,753

(22) Filed: Mar. 31, 2021

(65) Prior Publication Data

US 2022/0316221 A1 Oct. 6, 2022

(51) Int. Cl.
*E04F 21/18* (2006.01)
*E04F 15/02* (2006.01)

(52) U.S. Cl.
CPC .... *E04F 21/1877* (2013.01); *E04F 15/02011* (2013.01); *E04F 15/02022* (2013.01)

(58) Field of Classification Search
CPC ..... E04F 15/0211; E04F 15/02022; E04F 21/1877; E04F 21/241
See application file for complete search history.

(56) References Cited

U.S. PATENT DOCUMENTS 1,541,964 A * 6/1925 Harries ..... E04F 21/165 15/105.5
1,999,367 A 4/1935 Mccorkle
5,468,095 A * 11/1995 Dawson ..... B28B 7/02 404/118
5,699,580 A 12/1997 Silverstein
6,195,904 B1 * 3/2001 Greer ..... E04F 21/0076 33/526
6,308,370 B1 * 10/2001 Southby ..... E04F 21/20 15/236.08

(Continued)

FOREIGN PATENT DOCUMENTS

CN 201502164 U 6/2010
CN 204590538 U 8/2015

(Continued)

OTHER PUBLICATIONS

Warner Adjustable Inside Corner Trowel, Stainless Steel Blade, 214; https://www.amazon.com/Warner-Adjustable-Inside-Stainless-214/dp/B004S6QJIO/ref=asc_df_B004S6QJIO/?tag=hyprod-20&linkCode=df0&hvadid=309813767497&hvpos=&hvnetw=g&hvrand=7825002783191048257&hvpone=&hvptwo=&hvamt=&hvdev=c&hvdvemdl=&hvlocint=&hvlocphy=9032366&hvtargid=pla-322516045598&psc=1.
Floor Drain Trowel, https://www.markfasttools.com/shop/product-name-7rxb8.

(Continued)

*Primary Examiner* — Christine T Cajilig
(74) *Attorney, Agent, or Firm* — Cynthia S. Lamon; Lamon Patent Services

(57) ABSTRACT

A grout removal tool has a first long grout scraping board with an elongate through slot and a second long grout scraping board having at least two drill holes aligned with the slot for accepting screw bolts, the boards held together by screw bolts and wingnuts the boards adjustable to extend the overall working length of the tool. The tool further including a depth adjustment block mounted to one of the grout scraping boards, the block installed over threaded posts seated into the end of the host scraping board and extending through an elongate slot or slots with wingnuts, the depth adjustment block adjustable to preserve an offset dimension leveraged by an operator to remove excess grout from around a fixed feature by placing the offset block down on top of the fixed feature and removing grout around the feature according to the offset dimension.

12 Claims, 6 Drawing Sheets

(56) References Cited

U.S. PATENT DOCUMENTS

| | | | | |
|---|---|---|---|---|
| 8,096,056 | B1 * | 1/2012 | Murdock | G01B 3/566 33/526 |
| 10,232,403 | B1 * | 3/2019 | Daranuta | E04F 21/163 |
| 2007/0061988 | A1 | 3/2007 | Hurley | |
| 2007/0256393 | A1 * | 11/2007 | Black | E04G 21/10 52/749.13 |
| 2008/0052937 | A1 * | 3/2008 | Bailey | E04F 21/20 33/526 |
| 2008/0307663 | A1 * | 12/2008 | Peterson | B25H 7/02 33/527 |

FOREIGN PATENT DOCUMENTS

| | | | | |
|---|---|---|---|---|
| CN | 111350333 | A * | 6/2020 | E04F 21/162 |
| FR | 1309546 | A * | 11/1962 | E04F 21/20 |
| KR | 101312023 | B1 | 10/2013 | |
| TW | 418276 | B | 1/2001 | |
| WO | 2015084611 | A1 | 6/2015 | |

OTHER PUBLICATIONS 11 in. x 1/8 in. x 1/16 in. Flat Top V-Notch Pro Flooring Trowel with Wood Handle, https://www.homedepot.com/p/Roberts-11-in-x-1-8-in-x-1-16-in-Flat-Top-V-Notch-Pro-Flooring-Trowel-with-Wood-Handle-49737/100197989.

4 in. x 9.5 in. Molded Rubber Grout Float with Non-Stick Gum Rubber, https://www.homedepot.com/p/QEP-4-in-x-9-5-in-Molded-Rubber-Grout-Float-with-Non-Stick-Gum-Rubber-10060/310829229.

* cited by examiner section AA

GROUT LEVELER TOOL

CROSS-REFERENCE TO RELATED DOCUMENTS

[NA]

BACKGROUND OF THE INVENTION

1. Field of the Invention

The present invention is in the field of construction and pertains particularly to methods and apparatus for leveling ground (grout) surfaces underlying tile or similar overlays.

2. Discussion of the State of the Art

In the art of construction including masonry, tiles may be laid over tile grout to cover floors, drain basins, and other flat surfaces. Before tile is applied to flooring or more particularly to a drain basin of a shower, etc., the layer of grout that the tile will set in should be flat and in certain applications level. A grouting tool consisting of a flat shovel plate is typically applied to wet cement or grouting material to flatten the layer for the application of tiles on top of the layer. The consequence of not achieving a level base for laying tile may be that tiles of the same thickness do not lie in the same plane leaving one tile sitting higher than another and so on. In some applications like a tiled drain pan for a shower, for example, the tiles should be level or sit flush with the edge of the drain feature. In other applications other features may need to be flush with tiles such as vents, grates, and so on.

There are challenges to the operator attempting to level the grout in a shower drain with a typical shovel pan style grout tool. One challenge is there is no guide for the operator to determine how low to level the grout compared to a stationary feature like a shower drain. The operator must level by eye and constantly check accuracy around the drain feature by placing a loose tile on the leveled grout surface. Another challenge is the shorter length of a typical shovel pan style grouting tool that is used, for example, in a footprint that is much larger forcing more task work to cover the larger grout footprint.

Therefore, what is clearly needed is a grouting leveler tool that addresses the problems cited above.

BRIEF SUMMARY OF THE INVENTION

According to an embodiment of the present invention, a grout leveler tool is provided and includes a first grout scraping board having a length, a height, and a material thickness, the first grout scraping board including an elongate slot placed through the material thickness and contained within the overall length dimension of the board, the slot substantially aligned over longitudinal center line of the board at the planer elevation of the center of the board height, a second grout scraping board having a length, a height, and a material thickness identical to, or substantially similar to, the first grout scraping board, the second grout scraping board including at least two drill holes placed through the material thickness, spaced apart and aligned in substantial true position with the elongate slot placed through the first grout scraping board, the first and second grout scraping board held flush together by nut and bolt hardware, the second grout scraping board including two threaded posts seated into the end surface of the board at one end of the board the posts extending orthogonally therefrom and spaced apart linearly and vertically aligning with the vertical center line of the board, and a depth adjustment block having a length roughly equal to the height of the grout scraping boards, a material thickness roughly equal to the material thickness of the grout scraping boards, and a height dimension roughly equal to the thickness dimension of the block, the depth adjustment block including at least one elongate through slot extending vertically, the slot length substantially centered within the length dimension of the depth adjustment block, the depth adjustment block installed over the threaded posts extending from the end of the second grout scraping board using post and nut hardware.

In one embodiment, the nut and bolt hardware holding the first and second grout scraping boards together includes screw bolts, washers, and wingnuts. In one embodiment, the post and nut hardware holding the depth adjustment block to the end of the second grout scraping board includes threaded posts, washers, and wingnuts. In one embodiment, the grout scraping boards and the depth adjustment block are fabricated of wood, plastic, or metal. In one embodiment the scraping boards and adjustment block are aluminum or any combination, thereof.

In one embodiment, the drilled holes through the second scraper board and the elongate slot through the first scraper board share a uniform inside diameter just larger than the outside diameter of the bolt hardware. In a preferred embodiment, the first scraper board may be offset from true position with the second scraping board extending the overall length of the grout leveler tool. In a preferred embodiment, the depth adjustment block may offset upward or downward from true position with the end of the second grout scraping board, the offset dimension equaling the material thickness of a tile. In one embodiment, the first and second grout scraping boards may be connected together by way of a keyway groove feature formed one side of one board and a matching key feature formed on the side of the other board, the boards sliding into one another from the board ends.

According to one aspect of the present invention, a method is provided for adjusting the working length of a grout leveler tool having two grout scraping boards of roughly equal length, height, and material thickness, the scraper boards held together fictionally by screw bolt and nut hardware placed through two or more drill holes of a diameter to accept the screw bolts placed through one board, the drill holes aligned with an elongate slot placed through the other board, the slot having a slot width roughly the same as the diameter of the drill holes comprising (a) loosening the nuts threaded over the screw bolts holding the boards together, (b) sliding the board with the slot in one direction a desired amount of distance from the position of the other board, and (c) tightening the nuts to hold the boards in the extended position. In one aspect of the method, the nut and bolt hardware holding the first and second grout scraping boards together includes screw bolts, washers, and wingnuts.

In one aspect of the invention, a method is provided for adjusting a grout leveler tool for a tile thickness offset dimension measured from a surface feature of a fixed component installed on an unfinished grout bed and a desired flat finish plane of the grout bed, the grout leveler tool having two grout scraping boards of roughly equal length, height, and material thickness held together by screw bolt and nut hardware, and a depth adjustment block installed on the end of one of the grout scraping boards, the depth adjustment block having at least one elongate through slot, the depth adjustment block installed over threaded posts extending orthogonally through the at least one slot, from the end surface of the host grout scraping board with nut hardware threaded onto the posts to hold the block to the end of the scraper board comprising (a) with the grout leveler tool placed down of a flat surface, loosening the nuts threaded over the posts holding the depth adjustment block onto the end of the host scraping board, (b) placing a loose tile on the flat surface next to the depth adjustment block, (c) urging the depth adjustment block upward and then back down to rest on the top surface of the tile, and (d) tightening the nuts to preserve the offset state of the depth adjustment block. In one aspect of the method, the post and nut hardware holding the depth adjustment block to the end of the second grout scraping board include threaded posts, washers, and wingnuts.

DETAILED DESCRIPTION OF THE INVENTION

In various embodiments described in enabling detail herein, the inventor provides a unique system for leveling a grout base for application of a tile layer. A goal of the present invention is to provide a tool that may reduce guess work about the proper depth grout bed relative to a fixed feature to which the tile is to be made flush with. Another goal of the invention is to enable more grout surface to be removed in a single pass. The present invention is described using the following examples, which may describe more than one relevant embodiment falling within the scope of the invention.

Figure 1:
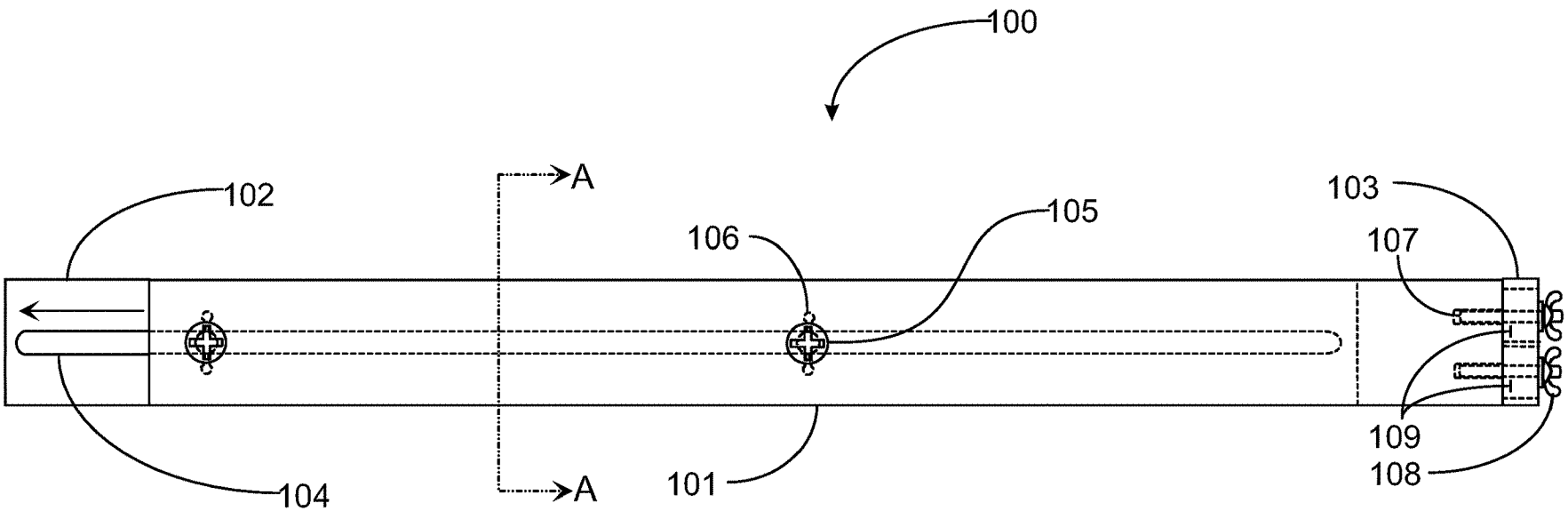
FIG. 1 is an elevation view of an adjustable grout leveler tool according to an embodiment of the present invention.

FIG. 1 is an elevation view of an adjustable grout leveler tool 100 according to an embodiment of the present invention. Leveler tool 100 is adapted as an adjustable tool assembly for leveling off grout to form a flat surface for tiles to be laid on to form tile flooring. Leveler tool 100 includes a rectangular first scraping board 101 having a length dimension, a height dimension, and a thickness dimension abutted against and assembled to a rectangular second scraping board 102 having identical or similar overall length, height, and thickness dimensions as the first scraping board. The first and second scraping boards may be fabricated of wood, plastic, metal, or another durable material.

Second scraping board 102 has an elongate alignment slot 104 placed through the material thickness roughly at longitudinal center of the first board. Slot 104 extends from one end of the second scraping board 102 to the opposite end of the second scraping board 102 without breaking out at either end of the board. Slot 104 has a substantially uniform width dimension large enough to accept the diameter of at least one threaded bolt 105 passed drilled hole openings provided through first scraping board 101 along the longitudinal center of the second scraping board 102 and in alignment with slot 104. First scraping board 101 may be held against the second scraping board 102 using wingnut hardware 106 threaded over bolt hardware 105 inserted through drilled holes in first scraping board 101 and the slot 104 of second scraping board 102.

An operator may loosen wingnuts 106 to pull the first and second scraping boards apart to allow scraping board 102 to be extended out from a true position with scraping board 101 along the direction of the arrow lengthening grout leveler tool 100 achieving a longer scraping plane on the tool bottom edge. For example, if leveler tool 100 is not extended it may have an overall length within a range of 10-15 inches. The leveler tool fully extended may produce an overall length for the tool within a range of 20-30 inches. The dimensions used here are exemplary only as leveler tool 100 may be manufactured in more than one size. However, an effective tool extending to 21 inches from 14 inches may be about two inches in height and one-quarter to 1 inch width per board resulting in one-half of an inch up to 2 inches, or so, total width (both boards clamped together). Other length, width, and height dimensioning may be adhered to without departing from the spirit and scope of the present invention.

Grout leveler tool 100 includes a vertically oriented rectangular depth adjustment block 103 that may be secured to one vertical end of first scraping board 101 opposite from the direction of the extension of tool 100. Depth adjustment block 103 may have a length roughly equal to the uniform height of the scraping boards 101 and 102 and a material thickness and height roughly the same as the material thickness of one scraping board. Depth adjustment block 103 may include one or more through slots 109 oriented orthogonally to the longitudinal center thereof, the slot width just larger than the diameter of one or more threaded posts 107 spaced apart and seated orthogonally into the end surface of scraping board 101.

In this embodiment there are two posts 107 each passing through a slot 109. Wingnuts 108 may be provided to thread over posts 107 to clamp or tighten block 103 against the vertical end surface of scraping board 101. Slots 109 are separated in this embodiment by a thin wall at vertical center of depth adjustment block 103. An operator may loosen wingnuts 108 to frictionally adjust block 103 upward or downward to produce an offset dimension relative to or equal to the thickness dimension of a tile.

The depth adjustment may be set by an operator, for example, to the measured thickness of a tile. The adjusted block offset may be placed over the top edge of a fixed feature in the grout footprint like a drain cup to which the setting tile should come flush in height with. The offset edge of block 103 may then be used to help gauge the depth that the leveled grout bed has to be from the top surface of the drain cup feature for a tile to lay at the same top plane level as the drain cup top surface.

A shower pan requiring a tiled floor and having a fixed drain feature provides one example of an application that tool 100 is specifically adapted for. However, there are other examples of grout footprints or grout beds to be tiled over having at least one fixed feature thereon where the plane is overlaid by tiles that should come flush to the top surface of the feature, or perhaps, should come to an offset dimension below the feature surface plane or above the feature surface plane depending upon the application and feature relationship in the design.

Figure 2:
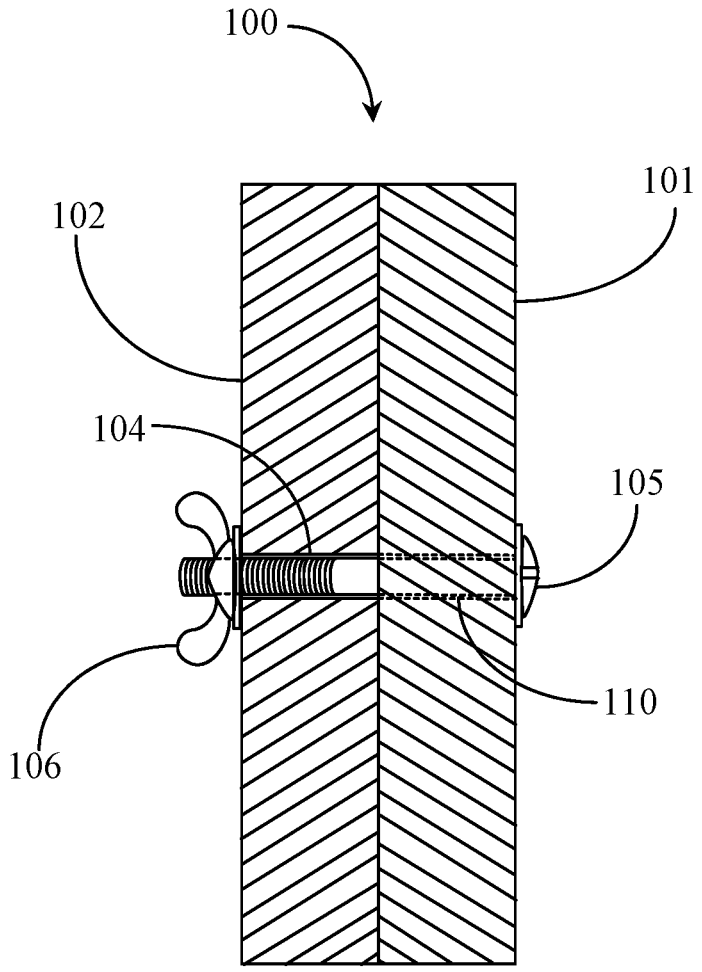
FIG. 2 is a sectioned view of the grout leveler tool of FIG. 1 taken along section line AA.

FIG. 2 is a sectioned view of grout leveler tool 100 of FIG. 1 taken along section line AA of FIG. 1. In one embodiment, first scraping board 102 and second scraping board 101 are held abutted together and flush with one another. Screw or bolt 105 extends from the outside surface of scraping board 101 through a drilled hole 110 provided for the purpose, and then through slot 104 to terminate outside of the facing vertical surface of scraping board 102. Wingnut 106 is provided to thread over screw bolt 105 and against a washer to tighten the two boards together. In one embodiment as depicted in FIG. 1, two bolts and two wingnuts are provided wherein elongate slot 104 is aligned with the drilled holes 110 openings for the bolts. In this way, when the boards are tightened together, friction keeps them from sliding, and they are held substantially flush with reference to height dimension.

In this embodiment, the interfacing facing sides of the first and second scraping boards are flat with no features other than the aforementioned drilled holes 110 aligned to slot 104 described in FIG. 1; however, that is not a requirement to practice the invention and should not be construed as a limitation. One with skill in the art will appreciate that first scraping board 101 and second scraping board 102 may be modified on the interfacing sides to fit together where one board may be slid laterally out from the other board to lengthen the grout leveling tool, for example, providing a key-way groove on one face and a matching key feature on the other face. A variation to the embodiment of FIG. 1 is provided later in this specification. In this embodiment, the drill holes 110 for bolts 105 and slot (104) described in FIG. 1 share the same diameter. The diameter may be held just above the diameter of the bolt using a small tolerance to reduce play when an operator loosens the wingnuts 106 to slide out first scraper board 102. In this way the shared scraping or grout moving surfaces are relatively flush (small tolerance) when the tool is again tightened by the operator.

Figure 3:
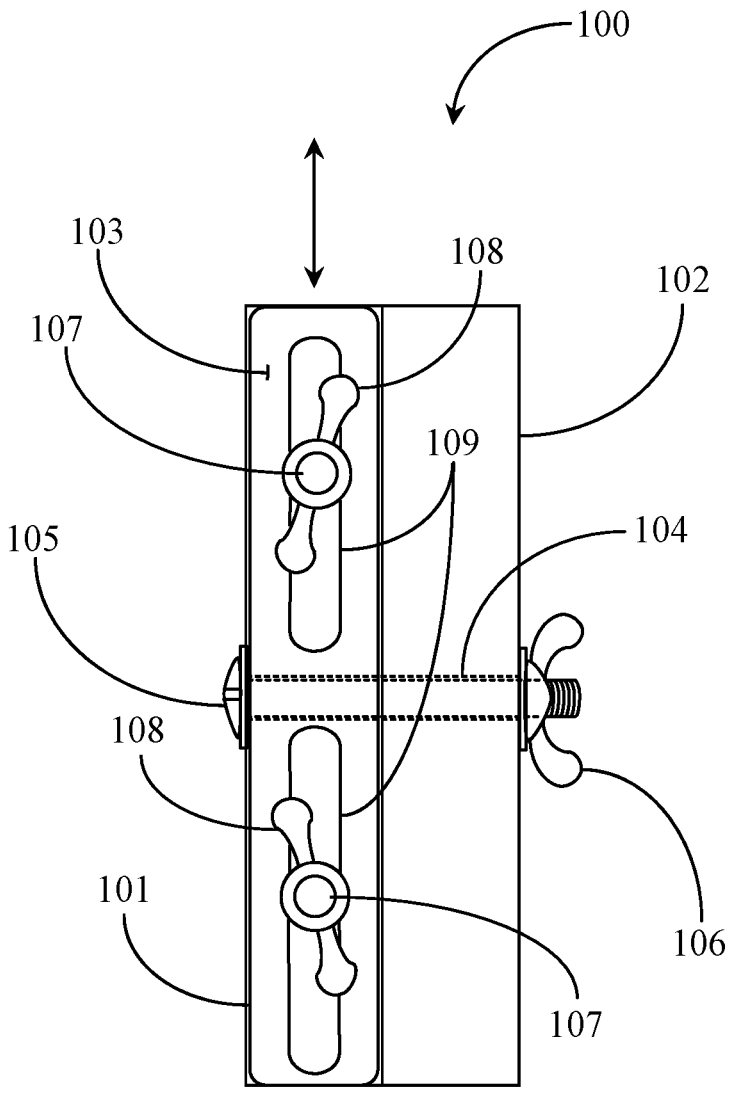
FIG. 3 is an end view of the grout leveler tool of FIG. 1 depicting a depth adjustment block according to an embodiment of the present invention.

FIG. 3 is an end view of grout leveler tool 100 of FIG. 1 depicting a depth adjustment block according to an embodiment of the present invention. Grout leveler tool 100 includes depth adjustment block 103 on one end of the tool opposite the direction of extension of the tool. Depth adjustment block 103 shares the height dimension of scraper boards 101 and 102. In this embodiment, block 103 shares the width of grout scraping board 101 and is installed on the end of board 101. Depth adjustment block has two vertically aligned through slots 109 spaced apart and extending linearly and aligned with the vertical center line of depth adjustment block 103. In this view, the scraping boards are held together by screw bolts 105 and wingnuts 106 through drilled holes 110 and slots 104.

Slots 109 share a uniform inside diameter held just larger than the outside diameter of a pair of threaded posts 107 as depicted in FIG. 1. Block 103 may be placed over posts 107 and wingnuts 108 may be threaded down over posts 107 to tighten the position of block 103 to the vertical end of scraping board 101. Depth adjustment block may be loosened from the end of scraper block 101 by loosening wingnuts 108 and then sliding block 103 upward or downward according to the directional double arrow.

In a preferred embodiment, depth adjustment block 103 may be adjusted upward an amount equal to the thickness dimension of a tile used to cover the grout bed, for example of the floor of a shower drain pan. Grout leveler tool may be placed on flat ground next to a loose tile. Depth adjustment block 103 may be loosened by an operator working with wingnuts 108 and slid upward past the thickness dimension of the tile. The operator may then put the tile under the bottom end of block 103 and may slide the block down onto the tile, and then may tighten the wingnuts to secure the depth setting, in this case, equal to the tile thickness.

The bottom edge of block 103 may then be placed down over the top surface of a fixed shower drain rim and the operator may remove excess grout keeping the edge of block 103 against the top surface of the drain rim for reference. This action produces a flat grout bed wherein tiles laid thereon will come flush to the top surface of the drain rim. In other embodiment, block 103 may be depth adjusted to other dimensions beside tile thickness without departing from the spirit and scope of the present invention and may be adjusted downward or upward to secure a specific dimensional offset if tile is to be set at an offset with the surface of a fixed feature within the grout bed footprint.

Figure 4:
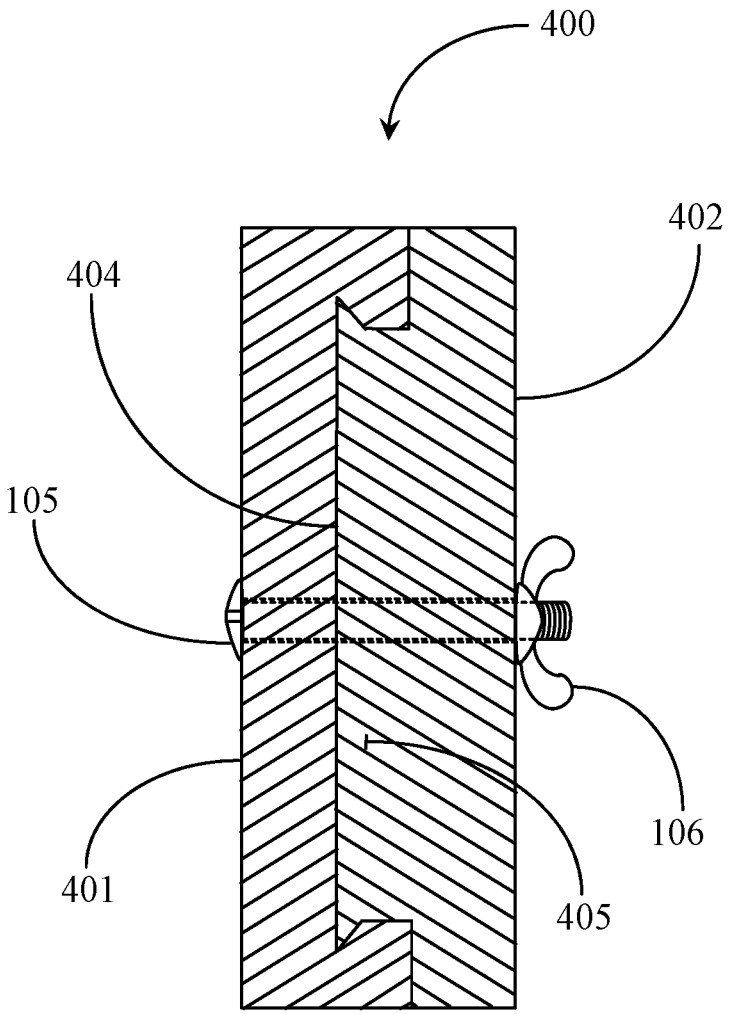
FIG. 4 is a sectioned view of an adjustable grout leveler tool according to another embodiment of the present invention.

FIG. 4 is a sectioned view of an adjustable grout leveler tool 400 according to another embodiment of the present invention. In this section view, it may be assumed taken from section lines similar to section lines AA of FIG. 1. In this view, a first scraping board 401 is connected to a second scraping board 402 by a keyed track interface consisting of a keyway groove feature 404 provided longitudinally across the interfacing surface of scraping board 401, and a matching key feature 405 provided longitudinally across the interfacing surface of scraping board 402.

Keyway feature 404 breaks out of both ends of the scraping board including an inside rim width dimension and an overall larger width dimension created by under-cutting the material on both sides of the groove or keyway providing a catch track for the matching dimensional feature of the key track 405. Key track 405 also breaks out at both ends of scraping board 402. An operator may physically insert scraping board 402 into scraping board 401 from either end of the boards. The anvil head of the key shape fitting into the angled undercuts provided at the base of the keyway feature prevent the boards from being pulled apart.

In this embodiment, a depth adjustment block may be provided at the end of scraping board 401 which maintains most of the original material thickness. Scraping board 402 may be designated as the length extending board. In this embodiment, scraping board 401 and scraping board 402 may be tightened together using the same hardware and slot configuration described above with reference to FIG. 1. Screw bolt 105 and wingnut 106 may be reversed from the orientation depicted here without departing from the spirit and scope of the invention. Moreover, slot (104) may be placed through board 401 instead of through board 402 without departing from the scope of the invention. The key interface profile depicted herein is exemplary only. Other keyway designs might also be incorporated without departing from the spirit and scope of the present invention.

In a variation of this embodiment, a slot 104 screw-bolt and wingnut hardware is not specifically required to hold the scraping boards together when one board is extended. In one embodiment, a tight dimensional tolerance between the undercut feature of keyway 404 and the anvil feature of key 405 is held so that the amount of friction force against the inside surfaces is sufficient to prevent undesired extension of scraper board 402 whereas moderate force by an operator may be used to easily extend tool 400 for use in a larger gout bed area.

Figure 5A:
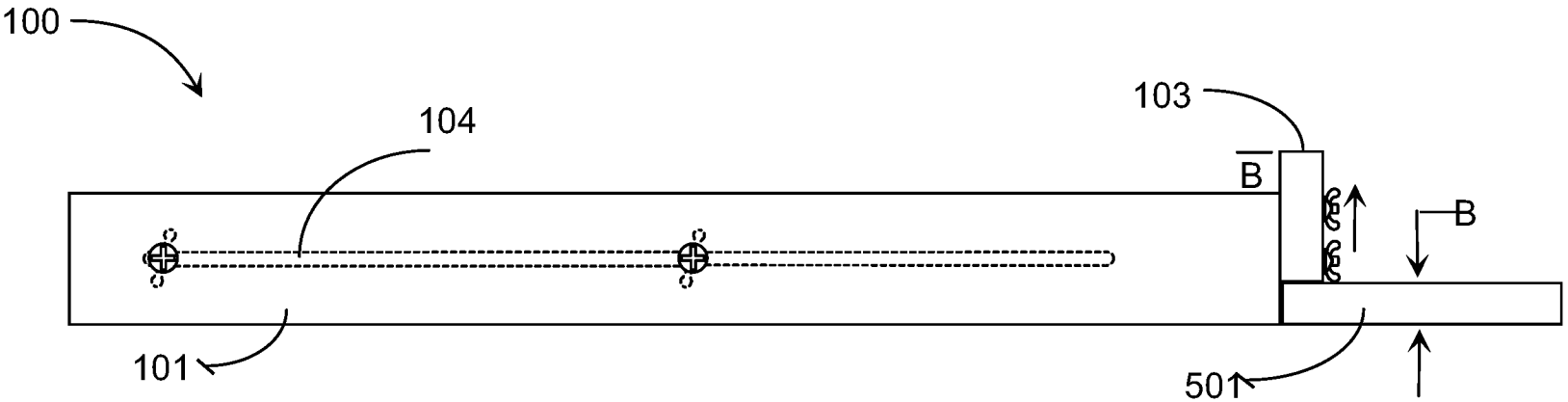
FIG. 5A is an elevation view of the adjustable grout leveler tool of FIG. 1 adjusted for the thickness dimension of a tile.

FIG. 5A is an elevation view of adjustable grout leveler tool 100 of FIG. 1 adjusted for the thickness dimension of a tile. It may be assumed in this view that grout leveler tool 100 is resting flat on a flat surface. An operator may loosen depth adjustment block 103 by loosening the wingnuts holding it tight against the vertical end of scraping board 101. The operator may raise the block upward in the direction of the arrow and place it down against adjacent loose tile 501 having a thickness dimension B. The operator may tighten the wingnuts down to secure the offset dimension equal to the thickness of tile 501. If depth adjustment block 103 shares the height dimension of scraping board 101, then dimension B is equal to the thickness dimension of tile 501 and is also locked in offset at the top side of the leveler tool 100.

Figure 5B:
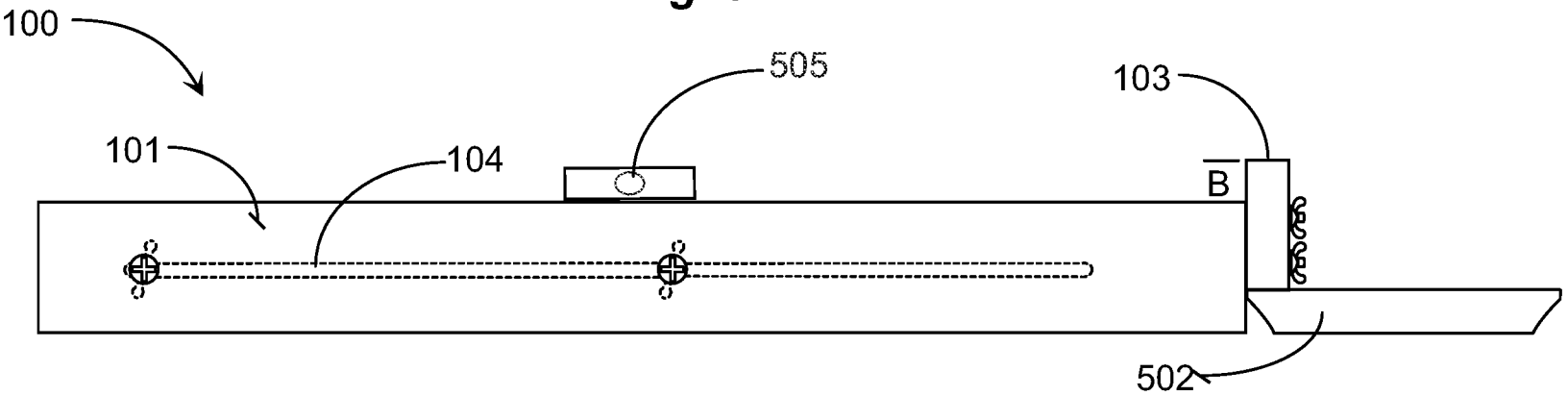
FIG. 5B is an elevation view of the adjustable grout leveler tool of FIG. 5A placed against a fixed feature to gauge depth of a leveled grout bed relative to tile thickness.

FIG. 5B is an elevation view of the adjustable grout leveler tool of FIG. 5A placed against a fixed feature to gauge depth of a leveled grout bed relative to tile thickness. Leveler tool 100 is depth adjusted and locked according to the tile thickness of offset dimension B of FIG. 5A. An operator may place leveler tool 100 next to a fixed drain feature 502 as he removes the excess grout on the grout bed to get the bed down to the correct depth. It may be assumed in this view, that the leveler tool 100 is lying flat on a finished grout bead with the depth adjustment block 103 laying flush on the top surface of drain rim 502. In a preferred embodiment, the operator makes grout removal passes around the drain keeping the depth adjustment block 103 resting against the drain rim for angular and depth reference as the operator moves grout out of the bed. In this embodiment a leveling device 505, either analog bubble type or laser, may be centered on a top edge of scraping board 101. In this embodiment an operator may use the leveling device 505 to create a level grout plane from a tile 501 or a drain 502, or the operator may choose to create a slight slope enabling control of water drainage into drain 502, after tile are placed on the grout plane.

Figure 6:
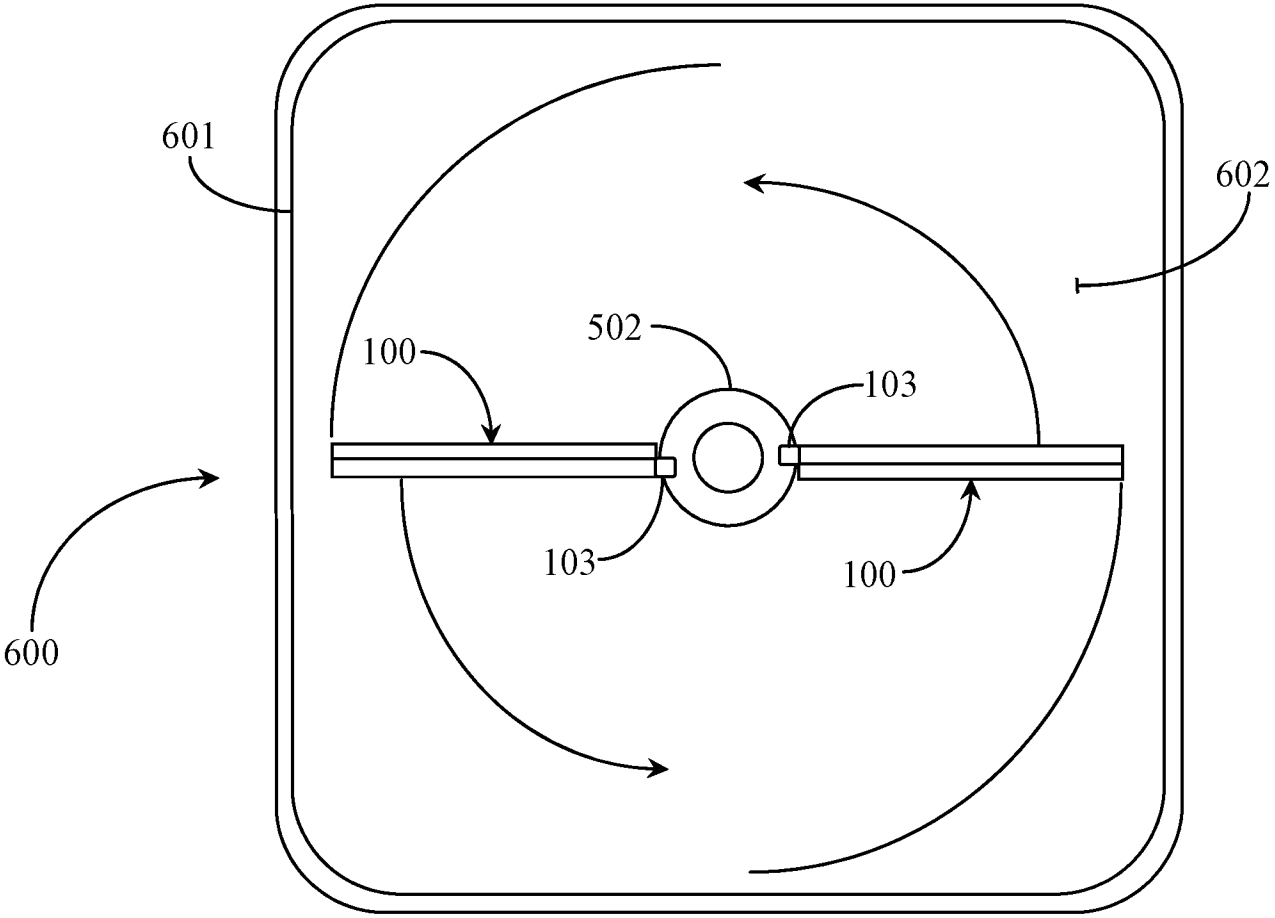
FIG. 6 is an overhead view of a shower drain pan depicting a circular motion for leveling grout using the adjustable grout leveling tool of FIG. 1.

FIG. 6 is an overhead view of a shower drain pan 600 depicting a circular motion for leveling grout using adjustable grout leveling tool 100 of FIG. 1. Shower drain pan 600 has an inside wall 601 that rises up from the floor of the pan and contains a grout bed 602. A drain feature 502 is fixed substantially at the center of the drain pan 600. Leveler tool 100 is depicted in two positions on either side of drain feature 502.

In this view, leveler tool 100 is not extended in length and hardware is not depicted for the purpose of clarity but may be assumed present. Block 103 is depth adjusted to the thickness of a tile that will be used to cover the floor of the shower pan 600. Leveler tool 100 may be positioned on the grout bed 602 with block 103 resting on the top surface of drain feature 502 for reference. Removing excess grout may take place around the drain feature in the direction of the arrows to create a flat grout bed at the planar depth of the thickness of the tile below the surface of the drain feature 502.

Leveler tool 100 may be extended in length to reach a larger perimeter and to remove the excess grout at most of the corner areas. In one embodiment, grout leveler tool 100 may include a liquid level bubble feature mounted at the top of one of or both of the scraper boards to gauge how flat the grout bed is in the bottom of shower pan 600. One with skill in the art may appreciate that there may be other hardware configurations provided that may keep the scraping boards of the grout leveling tool in flush alignment together without departing from the spirit and scope of the present invention.

It may also be appreciated that other hardware and extension methods might also be provided to extend one scraping board out relative to the other scraping board to lengthen the tool without departing from the spirit and scope of the invention. For example, in one embodiment a linear snap interface may be provided to snap and unsnap the scraping boards together at incremental extension lengths. In another embodiment a linear pin and socket interface might be provided to pull the scraping boards apart and place the scraping boards back together at incremental extension lengths. The inventor prefers a sliding interface between the boards for the purpose of convenience and quick task performance.

It will be apparent to people with skill in the art that the adjustable grout leveler tool of the present invention may be provided using some or all the elements described herein. The arrangement of elements and functionality thereof relative to the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A grout leveler tool comprising:

a first grout scraping board having a length, a height, and a material thickness, the first grout scraping board including an elongate slot placed through the material thickness and contained within the overall length dimension of the board, the slot substantially aligned over longitudinal center line of the board at the planer elevation of the center of the board height, the first grout scraping board including two threaded posts seated into the end surface of the board at one end of the board the posts extending orthogonally therefrom and spaced apart linearly and vertically aligning with the vertical center line of the board;

a second grout scraping board having a length, a height, and a material thickness identical to, or substantially similar to, the first grout scraping board, the second grout scraping board including at least two drill holes placed through the material thickness, spaced apart and aligned in substantial true position with the elongate slot placed through the first grout scraping board, the first and second grout scraping board held flush together by nut and bolt hardware; and a depth adjustment block having a length roughly equal to the height of the first and second grout scraping boards, a material thickness roughly equal to the material thickness of the first and second grout scraping boards, and a height dimension roughly equal to the thickness dimension of the block, the depth adjustment block including at least one elongate through slot extending vertically, the slot length substantially centered within the length dimension of the depth adjustment block, the depth adjustment block installed over the threaded posts extending from the end of the first grout scraping board using post and nut hardware.

2. The grout leveler tool of claim 1, wherein the nut and bolt hardware holding the first and second grout scraping boards together includes screw bolts, washers, and wingnuts.

3. The grout leveler tool of claim 1, wherein the post and nut hardware holding the depth adjustment block to the end of the first grout scraping board include threaded posts, washers, and wingnuts.

4. The grout leveler tool of claim 1, wherein the grout scraping boards and the depth adjustment block are fabricated of wood, plastic, or metal.

5. The grout leveler tool of claim 1, wherein the drilled holes through the second grout scraper board and the elongate slot through the first grout scraper board share a uniform inside diameter just larger than the outside diameter of the bolt hardware.

6. The grout leveler tool of claim 1, wherein the first grout scraper board may be offset from true position with the second grout scraping board extending the overall length of the grout leveler tool.

7. The grout leveler tool of claim 1, wherein the depth adjustment block may offset upward or downward from true position with the end of the first grout scraping board, the offset dimension equaling the material thickness of a tile.

8. The grout leveler tool of claim 1, wherein the first and second grout scraping boards may be connected together by way of a keyway groove feature formed one side of one board and a matching key feature formed on the side of the other board, the boards sliding into one another from the board ends.

9. A method for adjusting the working length of a grout leveler tool, the grout leveling tool having a first grout scraping board having threaded posts extending from an end surface, the threaded posts linearly spaced apart and vertically aligned with the vertical center line of the first grout scraping board, a second grout scraping board having a length, height, and material thickness roughly equal to the first grout scraping board, and a depth adjustment block having a length roughly equal to the height of the first and second grout scraping boards and a height dimension roughly equal to the material thickness dimension of the depth adjustment block and at least one first through slot extending vertically, the first slot length substantially centered within the length dimension of the depth adjustment block, the depth adjustment block installed over the threaded posts on the end of the first grout scraping board, the threaded posts extending orthogonally through the at least one first slot, the first and second grout scraper boards held together fictionally by screw bolt and nut hardware placed through two or more drill holes of a diameter to accept the screw bolts placed through one board, the drill holes aligned with a second elongate slot placed through the other board, the second slot having a slot width roughly the same as the diameter of the drill holes comprising:

(a) loosening the nut hardware threaded over the screw bolts holding the boards together;

(b) sliding the board with the second slot in one direction a desired amount of distance from the position of the other board; and (c) tightening the nut hardware to hold the boards in the extended position.

10. The method of claim 9, wherein the nut and bolt hardware holding the first and second grout scraping boards together includes screw bolts, washers, and wingnuts.

11. A method for adjusting a grout leveler tool for an offset dimension measured from a surface feature of a fixed component installed on an unfinished grout bed and a desired flat finish plane of the grout bed, the grout leveler tool having a first grout scraping board having threaded posts extending from an end surface, the threaded posts linearly spaced apart and vertically aligned with the vertical center line of the first grout scraping board, a second grout scraping board having a length, height, and material thickness roughly equal to the first grout scraping board, the first and second grout scraping boards held together by screw bolt and nut hardware, and a depth adjustment block having a length roughly equal to the height of the first and second grout scraping boards, a height dimension roughly equal to the material thickness dimension of the block, and at least one elongate through slot extending vertically, the slot length substantially centered within the length dimension of the depth adjustment block, comprising:

(a) installing the depth adjustment block over the threaded posts, the threaded posts extending orthogonally through the at least one elongate through slot;

(b) threading nut hardware onto the threaded posts to hold the block to the end of the first grout scraper board;

(c) setting the offset dimension by loosening the nut hardware on the threaded posts, sliding the depth adjustment block up or down, then tightening the nut hardware on the threaded posts to preserve the offset state of the depth adjustment block.

12. The method of claim 11, wherein the post and nut hardware holding the depth adjustment block to the end of the first grout scraping board include threaded posts, washers, and wingnuts.

* * * * *